US006260461B1

(12) United States Patent
Mok

(10) Patent No.: US 6,260,461 B1
(45) Date of Patent: Jul. 17, 2001

(54) SECURITY CUTTER

(76) Inventor: Chiu Nang Mok, 14th Floor, Wai Lun Mansion, 80 Hennesy Road, Wan Chai (HK)

( * ) Notice: Subject to any disclaimer, the term of this patent is extended or adjusted under 35 U.S.C. 154(b) by 0 days.

(21) Appl. No.: 09/392,159

(22) Filed: Sep. 8, 1999

(51) Int. Cl.[7] ..... B26D 5/08
(52) U.S. Cl. ..... 83/564; 30/160
(58) Field of Search ..... 83/563, 564; 30/160, 30/161, 331

(56) References Cited

U.S. PATENT DOCUMENTS 1,527,835 2/1925 Burke .
1,795,394 3/1931 Hirsch .
2,199,430 * 5/1940 Greve ..... 30/160
2,304,601 * 12/1942 Schrade ..... 30/160
2,488,432 * 11/1949 Paynter ..... 83/564
4,009,905 3/1977 Bejeannin .
5,097,733 3/1992 Benkoski .

FOREIGN PATENT DOCUMENTS 3434374 9/1984 (DE) .

* cited by examiner

*Primary Examiner*—W. Donald Bray
(74) *Attorney, Agent, or Firm*—Jackson Walker L.L.P.

(57) ABSTRACT

A security cutter comprising a body for fixing onto a support, a saw blade supported by the body for movement between a normal position contained wholly within the body and an operating position extending out from the body, a spring urging the saw blade towards the operating position, and a releasable lock for locking the saw blade in the normal position.

9 Claims, 2 Drawing Sheets

SECURITY CUTTER

The present invention relates to a security cutter that can be used to enable a person who has his hands tied together to free himself.

BACKGROUND OF THE INVENTION

In the case of burglary, the occupant in the premises concerned will usually be overcome and then tied up by the burglar. After the burglar has left, it would usually take some time before the restrained person can, if possible, struggle free or find a cutter to free himself before he can call the police.

The invention seeks to provide a security cutter that is readily available for such use.

SUMMARY OF THE INVENTION

According to the invention, there is provided a security cutter comprising a body for fixing onto a support, a cutting member supported by the body for movement between a normal position substantially wholly within the body and an operating position extending out from the body, resilient means urging the cutting member towards the operating position, and a releasable lock for locking the cutting member in the normal position.

Preferably, the body has a slot through which the cutting member is movable between the two positions.

In a preferred construction, the cutting member is pivotably connected to the body.

More preferably, the cutting member has a cutting edge which is arranged, in the operating position, to face upwards and be inclined from the body.

In a preferred embodiment, the cutting member is in the form of a saw blade.

More preferably, the saw blade has a series of teeth facing towards the body.

It is preferred that the cutting member has a lower end connected to the body and an upper end for engagement by the lock.

It is further preferred that the resilient means is in the form of a spring co-acting between the lower end of the cutting member and the body.

Preferably, a damper is provided between the lower end of the cutting member and the body for acting against the action of the resilient means.

More p referably, the lower end of the cutting member is toothed, and the damper comprises a gearwheel in mesh with said lower end.

In a preferred embodiment, the lock is in the form of a spring-loaded latch.

More preferably, the latch incorporates a press-knob for operation.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 4:
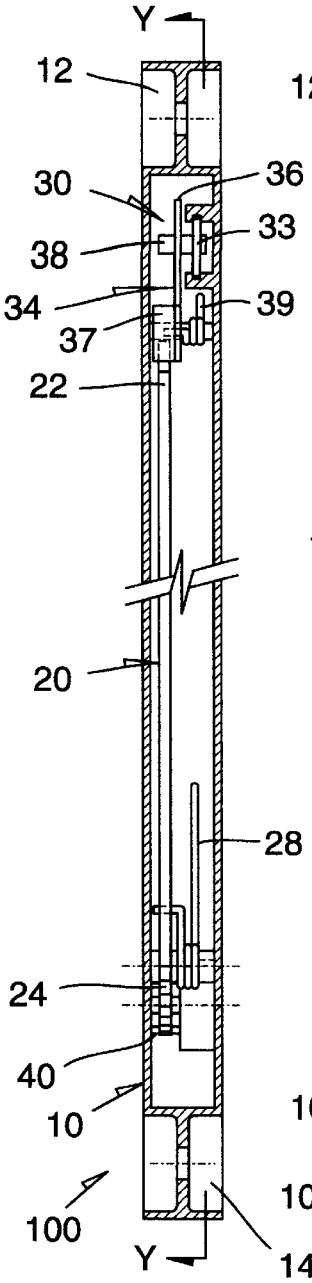
FIG. 4 is a cross-sectional front view of the security cutter corresponding to FIG. 2 and taken along line X—X of FIG. 3.
Figure 1:
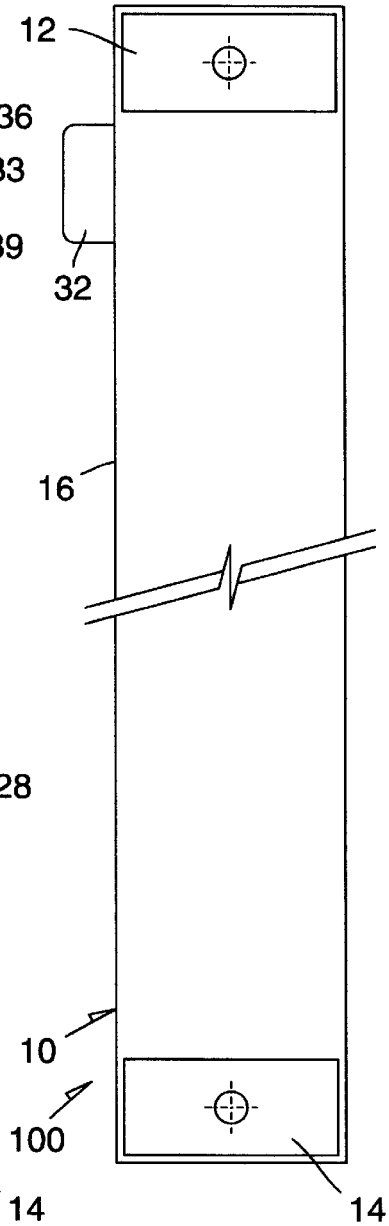
FIG. 1 is a side view of an embodiment of a security cutter in accordance with the invention.
Figure 2:
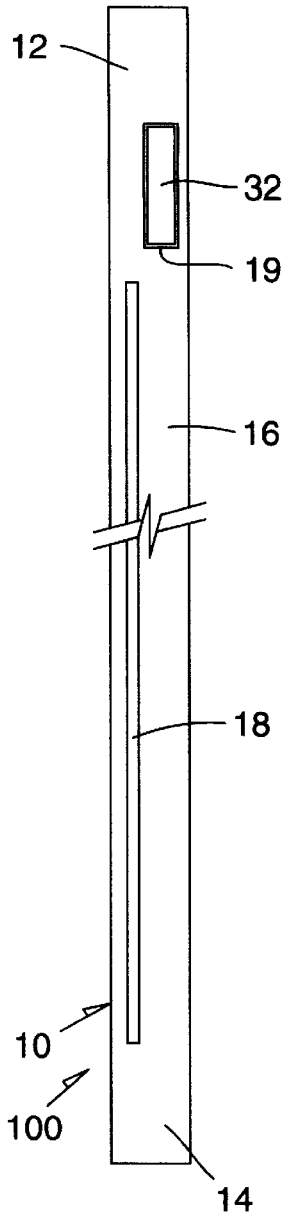
FIG. 2 is a front view of the security cutter of FIG. 1.

Referring initially to FIGS. 1 to 5 of the drawings, there is shown a security cutter 100 embodying the invention, which cutter 100 has an upright flat rectangular body 10 including top and bottom ends 12 and 14 and a narrow vertical front wall 16. Extending along its length, the front wall 16 is formed with a principal slot 18 and a shorter slot 19 above the principal slot 18. The top and bottom ends 12 and 14 are apertured for the body 10 to be fixed by means of screws onto a vertical support surface.

Figures 3, 5:
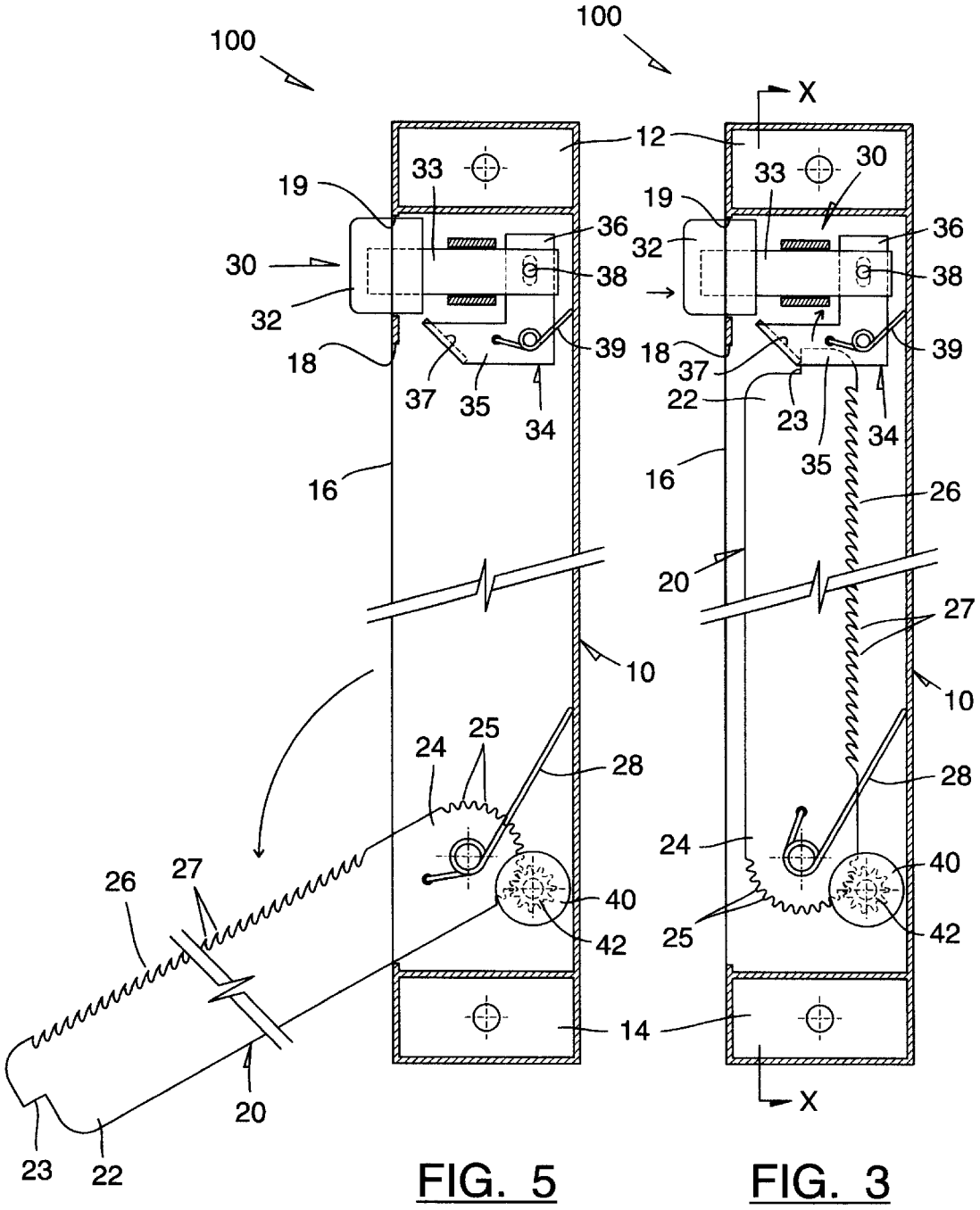
FIG. 3 is a cross-sectional side view of the security cutter corresponding to FIG. 1 and taken along line Y—Y of FIG. 4, which is shown in a normal condition.
FIG. 5 is a cross-sectional side view of the security cutter corresponding to FIG. 3, which is shown in an operating condition.

The security cutter 100 includes, internally of the body 10, a saw blade 20 having upper and lower ends 22 and 24 and a releasable lock 30 provided adjacent the saw blade upper end 22. The saw blade 20 is hinged at its lower end 24 to the body 10 for pivotal movement, through the slot 18, between a normal position contained wholly within the body 10 (FIG. 3) and an operating position extending out from the body 10 (FIG. 5). The saw blade 20 has a toothed cutting edge 26 which is arranged to face upwards and be inclined at an obtuse angle (of about 120°) from the body 10, when the saw blade 20 is in the operating position, with its teeth 27 facing the body 10 for convenient cutting action. The lock 30 serves to hold the saw blade 20 in the normal position inside the body 10.

The saw blade 20 is resiliently biassed towards the operating position by means of an elbow spring 28 which is provided at the lower end 24 and bears against the rear wall of the body 10. The blade end 24 has a semi-circular shape and is formed with gear teeth 25 for meshing with a gearwheel 42 of an oil-filled damper 40. The damper 40 serves to slow down the movement of the saw blade 20 towards the operating position, under the action of the spring 28. The upper end 22 of the saw blade 20 is formed with a step 23 for engagement by the lock 30.

The lock 30 comprises a press-knob 32 having a strip-like horizontal stem 33 and includes an L-shaped latch plate 34. The stem 33 is slidably supported behind the slot 19, thereby positioning the press-knob 32 through the slot 19 for operation. The latch plate 34 has a horizontal limb 35 co-extending below the stem 33 and a vertical limb 36 crossing with the rear end of the stem 33. The horizontal limb 35 is folded sideways to form an inclined end hook 37 for engaging the upper end 22 of the saw blade 20 at the step 23. The vertical limb 36 is connected to the stem 33 by means of a sliding hinge 38.

The latch plate 34 is hinged for pivotal movement between a locking position to have its end hook 37 in engagement with the upper end 22 of the saw blade 20 (FIG. 3) and an alternative position to release the saw blade 20. An elbow spring 39 is used at the hinge position for resiliently biassing the latch plate 34 towards the locking position.

Figure 6:
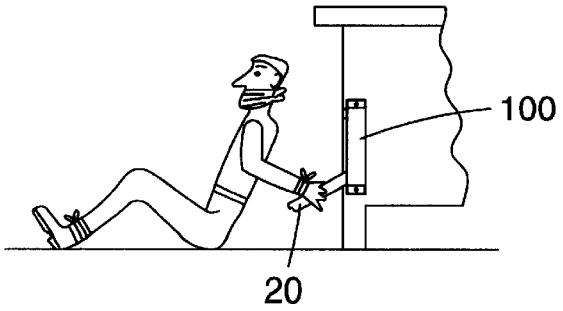
FIG. 6 is a reduced side view of the security cutter corresponding to FIG. 5, illustrating its use by a person having his hands tied behind him.

Reference is now made to FIG. 6 of the drawings. The security cutter 100 is intended for use at a location where a person would likely be left or held by a burglar, after his hands having been tied together behind him with a rope, wire or cable tie at the back. Examples of such locations are a bathroom, a storeroom and a bedroom. The body 10 of the security cutter 100 may be fixed by means of screws as described above, or by double-sided adhesive tape, onto the leg of a table, closet or bed, etc.

In operation, depression of the press-knob 32 will cause the latch plate 34 to rotate and thus release the saw blade 20, which will in turn pivot downwards out of the body 10 to present its cutting edge 26 for use. The saw blade 20 will come to rest against the lower end of the slot 18, with an impact sound kept to a minimum (so as not to alert the burglar) due to the action of the damper 40 that slows down the saw blade pivotal movement. After having successfully cut open the rope, or the like, to free himself, the person may try to escape or call the police.

The use of a saw blade is particularly preferred because it can cut through strong material such as metal and is safer to use that a knife. It is envisaged that the described security cutter may also be mounted inside the boot of a car.

The invention has been given by way of example only, and various modifications of and/or alterations to the described embodiment may be made by persons skilled in the art without departing from the scope of the invention as specified in the appended claims.

What is claimed is:

1. A security cutter comprising:

body for fixing onto a support;

a cutting member supported by said body for movement between a normal position substantially wholly within said body and an operating position extending out from said body, said cutting member in the form of a saw blade further comprising a series of teeth facing towards said body, a lower end connected to said body and an upper end for engagement by a releasable lock;

resilient means urging said cutting member towards said operating position, said releasable lock for locking said cutting member in said normal position; and a damper provided between said lower end of said cutting member and said body for slowing down movement of said cutting member from said normal position to said operating position against the action of said resilient means.

2. A security cutter as claimed in claim 1, wherein said body has a slot through which said cutting member is movable between said two positions.

3. A security cutter as claimed in claim 1, wherein said cutting member is pivotally connected to said body.

4. A security cutter as claimed in claim 3, wherein said cutting member has a cutting edge which is arranged, in said operating position, to face upwards and be inclined from said body.

5. A security cutter as claimed in claim 1, wherein said resilient means is in the form of a spring co-acting between said lower end of said cutting member and said body.

6. A security cutter as claimed in claim 1, wherein said lower end of said cutting member is toothed, and said damper further comprises a gearwheel in mesh with said lower end.

7. A security cutter as claimed in claim 1, wherein said lock is in the form of a spring-loaded latch.

8. A security cutter as claimed in claim 7, wherein said latch incorporates a press-knob for operation.

9. A security cutter comprising:

a body for fixing onto a support, a cutting member supported by said body for movement between a normal position substantially wholly within said body and an operating position extending out from said body, said cutting member in the form of a saw blade further comprising a series of teeth facing towards said body, said cutting member having a lower end connected to said body and an upper end for engagement by a releasable lock; and resilient means urging said cutting member towards said operating position, said releasable lock for locking said cutting member in said normal position.

* * * * *